US005392599A

United States Patent [19]

Hamburg et al.

[11] Patent Number: 5,392,599

[45] Date of Patent: Feb. 28, 1995

[54] ENGINE AIR/FUEL CONTROL WITH ADAPTIVE CORRECTION OF EGO SENSOR OUTPUT

[75] Inventors: Douglas R. Hamburg, Bloomfield; Eleftherios M. Logothetis, Birmingham, both of Mich.

[73] Assignee: Ford Motor Company, Dearborn, Mich.

[21] Appl. No.: 179,271

[22] Filed: Jan. 10, 1994

[51] Int. Cl.[6] ..... F01N 3/20

[52] U.S. Cl. ..... 60/274; 60/276; 60/285; 123/703

[58] Field of Search ..... 60/274, 276, 277, 285; 123/674, 703

[56] References Cited

U.S. PATENT DOCUMENTS 3,973,529 8/1976 Wessel ..... 60/276
4,170,965 10/1979 Aono .
4,251,990 2/1981 Norimatsu ..... 60/276
4,272,329 6/1981 Hetrick et al. .
4,272,330 6/1981 Hetrick .
4,272,331 6/1981 Hetrick .
5,115,639 5/1992 Gopp .
5,117,631 6/1992 Moser ..... 60/276
5,157,919 10/1992 Gopp .
5,159,810 11/1992 Grutter et al. .
5,168,700 12/1992 Furuya .

OTHER PUBLICATIONS

ACS Symposium Series 309, entitled "Fundamentals and Applications of Cehmical Sensors" by Dennis Schuetzle and Robert Hammerle.

*Primary Examiner*—Ira S. Lazarus
*Assistant Examiner*—Daniel J. O'Connor
*Attorney, Agent, or Firm*—Allan J. Lippa; Roger L. May

[57] ABSTRACT

Engine air/fuel ratio is controlled in response to a comparison of an exhaust gas oxygen sensor output with a reference value. A correction voltage is generated which is related to a change in the midpoint between saturated output states of the sensor during a test period in which engine air/fuel operation is first forced rich and then forced lean of a preselected air/fuel ratio. The sensor output amplitude is shifted with the correction voltage to reduce variations between the reference value and the midpoint.

16 Claims, 6 Drawing Sheets

ENGINE AIR/FUEL CONTROL WITH ADAPTIVE CORRECTION OF EGO SENSOR OUTPUT

BACKGROUND OF THE INVENTION

The field of the invention relates to control systems for maintaining engine air/fuel operation in response to an exhaust gas oxygen sensor. In a particular aspect, the field further relates to correcting the EGO sensor output.

Air/fuel ratio feedback control systems responsive to exhaust gas oxygen sensors are well known. The sensor output is typically compared to a reference value selected at the approximate midpoint in expected peak-to-peak excursion of the sensor output. Ideally, a two-state signal is thereby generated which indicates when engine air/fuel operation is either rich or lean of a predetermined air/fuel ratio such as stoichiometry. In an attempt to compensate for fluctuations in the sensor output due to deterioration or low temperature, an approach was disclosed in U.S. Pat. No. 4,170,965 to time average the sensor output through an RC filter, and use the time averaged value as the reference value.

The inventors herein have recognized several problems with the above approach. Using a time averaged output of the EGO sensor as the comparison reference will not always result in alignment of the reference with the midpoint in peak-to-peak excursion of the EGO sensor output. For example, when the sensor output is asymmetrical, or the sensor output is at other than a fifty percent duty cycle, the reference voltage will not be in alignment with the midpoint of the peak-to-peak sensor output. The switch point in the two-state signal may therefore not be in perfect alignment with the peak efficiency operating window of the catalytic converter.

SUMMARY OF THE INVENTION

An object of the invention herein is to correct the EGO sensor output for voltage shifts which may occur with sensor aging or low temperature.

The above object is achieved, and problems of prior approaches overcome, by providing an engine air/fuel control system and method for correcting an output of an exhaust gas oxygen sensor positioned in the engine exhaust in series with a catalytic converter. In one particular aspect of the invention, the method comprises the steps of: controlling the engine air/fuel ratio in response to a comparison of the sensor output with a reference value; forcing engine air/fuel operation sufficiently rich and then sufficiently lean of a preselected air/fuel ratio during a test period to force the sensor output into its respective saturated rich indicating state and saturated lean indicating state; and shifting the sensor output to align a midpoint between output amplitude at the saturated rich indicating state and output amplitude at the saturated lean indicating state with the reference value. Preferably, the step of generating the correction voltage further comprises the step of determining a voltage shift in the sensor output from the reference value by subtracting the reference value from the midpoint. An indication of efficiency may also be provided by comparing an absolute difference between the voltage shift and the average voltage shift to a preselected value.

An advantage of the above aspect of the invention is that, after correction, the midpoint between respective saturated output states substantially occurs at the reference value. Greater dynamic range and less susceptibility to noise thereby results.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
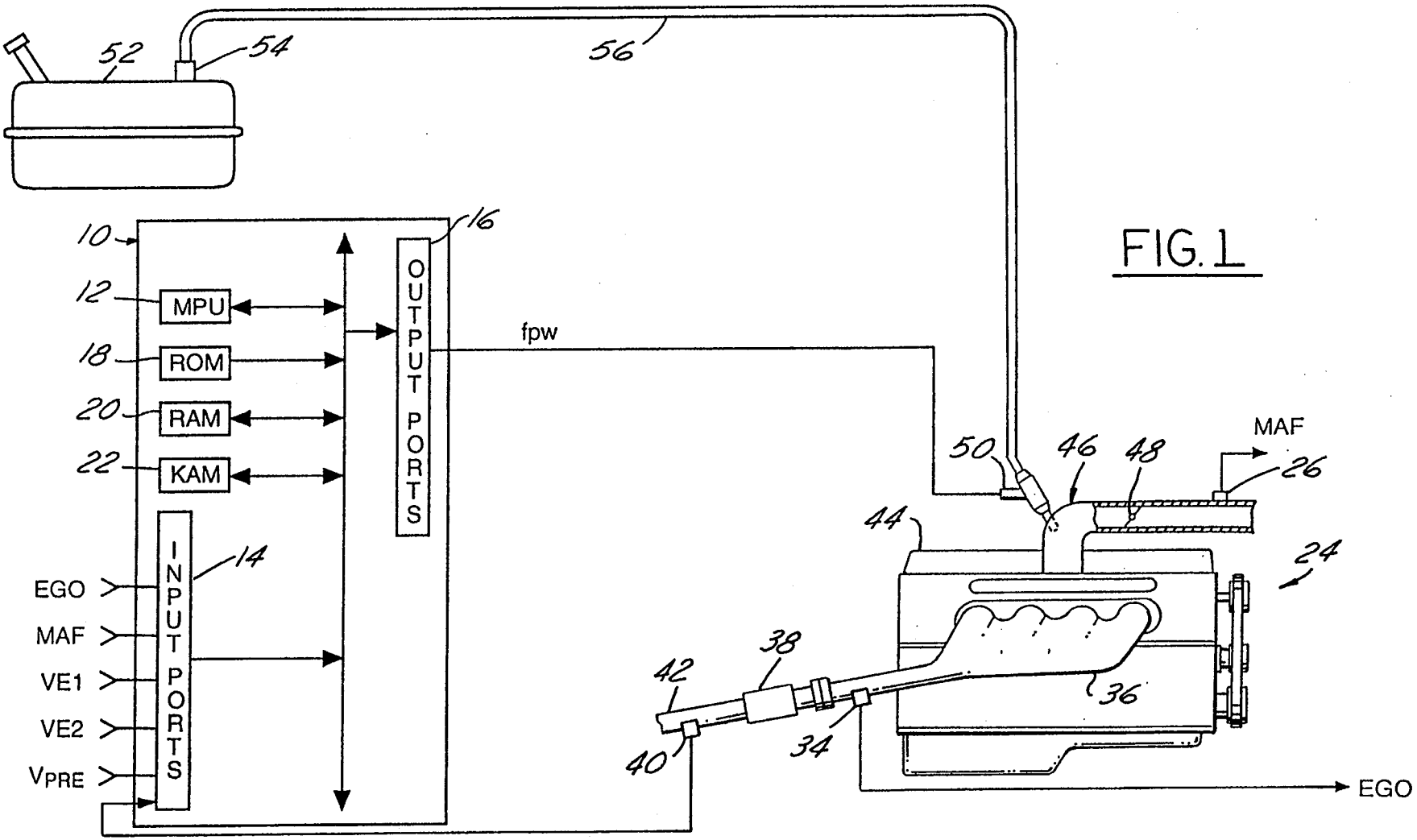
FIG. 1 is a block diagram of an embodiment wherein the invention is used to advantage.

Controller 10 is shown in the block diagram of FIG. 1 as a conventional microcomputer including: microprocessor unit 12; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing learned values; and a conventional data bus.

In this particular example, pre-catalyst exhaust gas oxygen (EGO) sensor 34 is shown coupled to exhaust manifold 36 of engine 24 upstream of conventional catalytic converter 38. Post-catalyst EGO sensor 40 is shown coupled to tailpipe 42 downstream of conventional catalytic converter 38.

Intake manifold 44 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 2A:
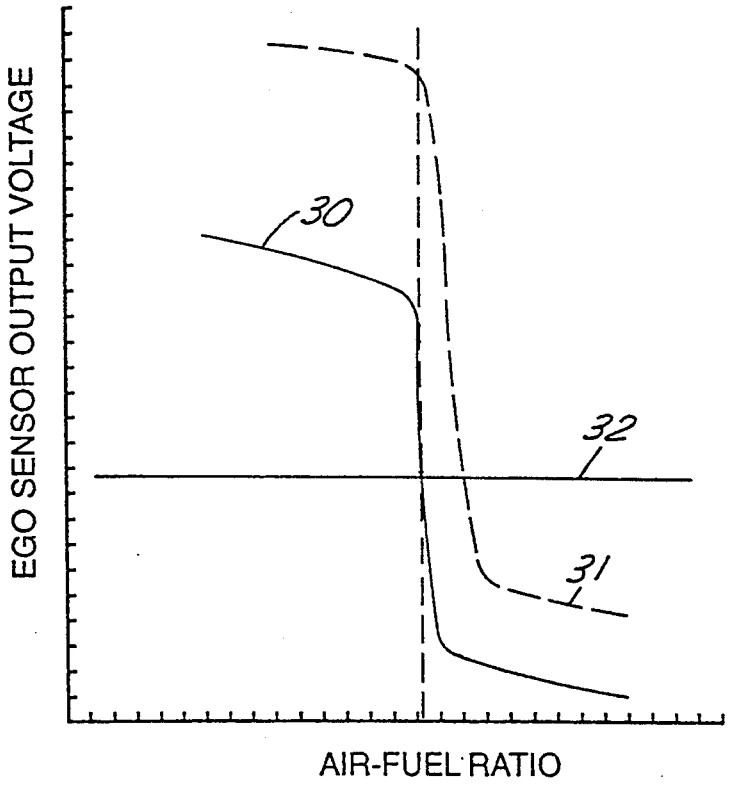
FIGS. 2A and 2B illustrate various outputs associated with an exhaust gas oxygen sensor.
Figure 2B:
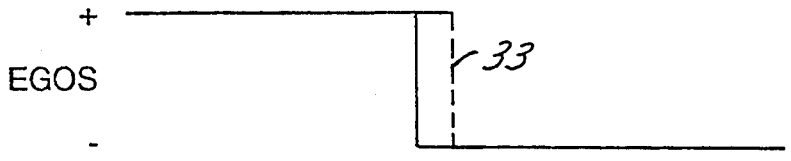

As shown in FIGS. 2A and 2B, a step change in the output amplitude of EGO sensor 34 between saturated rich and saturated lean indicating states has a midpoint which occurs at an air/fuel ratio (AFR) which is predetermined for a particular sensor. The inventors herein have found that predetermined ratio AFR may not coincide with stoichiometry or the converter's efficiency window. Further, the midpoint between saturated output states may shift with aging and temperature of an EGO sensor.

Signal EGOS, as described in greater detail later herein, is generated by comparing the output voltage of EGO sensor 34 (line 30) to a reference voltage (line 32) shown in this example at a midpoint in peak-to-peak excursion of the output step change from EGO sensor 34. Signal EGOS is a two-state signal which indicates whether combustion gases are rich or lean of the air/fuel ratio corresponding to the output midpoint from EGO sensor 34. As described in greater detail later herein, dashed lines 31 and 33 in FIGS. 2A and 2B respectively represent shifts in EGO sensor 34 output and signal EGOS which may occur with EGO sensor aging and temperature variations.

Figure 3:
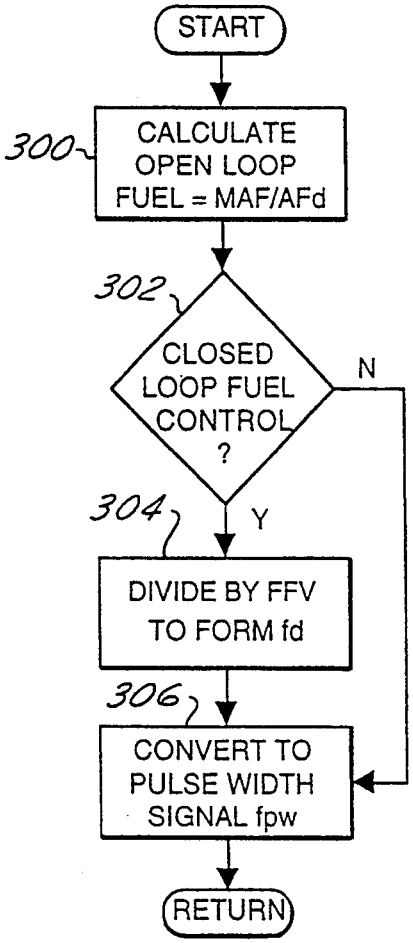
FIGS. 3, 4, 5A–5B, and 6 are high level flowcharts illustrating various steps performed by a portion of the embodiment illustrated in FIG. 1.

A flowchart of the liquid fuel delivery routine executed by controller 10 for controlling engine 24 is now described beginning with reference to the flowchart shown in FIG. 3. An open loop calculation of desired liquid fuel is calculated in step 300. More specifically, the measurement of inducted mass airflow (MAF) from sensor 26 is divided by a desired air/fuel ratio (AFd) correlated with stoichiometric combustion. After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306).

Figure 4:
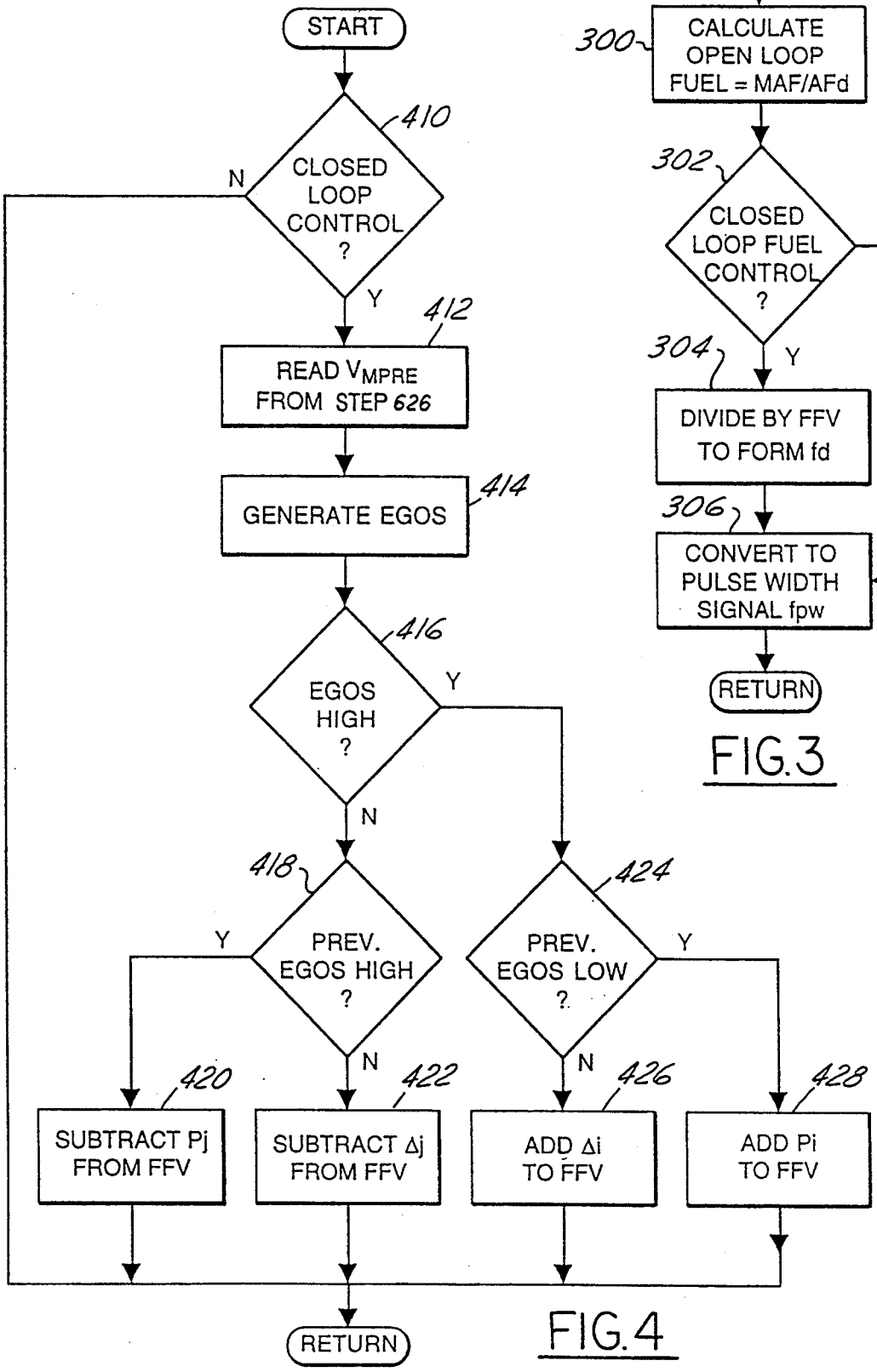

The air/fuel feedback routine executed by controller 10 to generate fuel feedback variable FFV is now described with reference to the flowchart shown in FIG. 4. After determining that closed loop air/fuel control is desired in step 410, modified output voltage $V_{MPRE}$ derived from EGO sensor 34 is read (step 412) from the amplitude correction routine described in greater detail later herein with reference to FIGS. 5A–5B. As also described in greater detail later herein, the step output of EGO sensor 34 is modified or shifted by biasing EGO sensor 34 in response to post-catalyst emissions feedback signal PCFS to shift the output step change towards the converter's efficiency window.

Two-state exhaust gas oxygen sensor signal EGOS is generated in step 414 by comparing modified output voltage $V_{MPRE}$ to reference 32 (see FIG. 2A). When signal EGOS is low (step 416), but was high during the previous background loop of microcontroller 10 (step 418), preselected proportional term Pj is subtracted from feedback variable FFV (step 420). When signal EGOS is low (step 416), and was also low during the previous background loop (step 418), preselected integral term Δj is subtracted from feedback variable FFV (step 422).

Similarly, when signal EGOS is high (step 416), and was also high during the previous background loop of controller 10 (step 424), integral term Δi is added to feedback variable FFV (step 426). When signal EGOS is high (step 416), but was low during the previous background loop (step 424), proportional term Pi is added to feedback variable FFV (step 428).

Figure 5A:
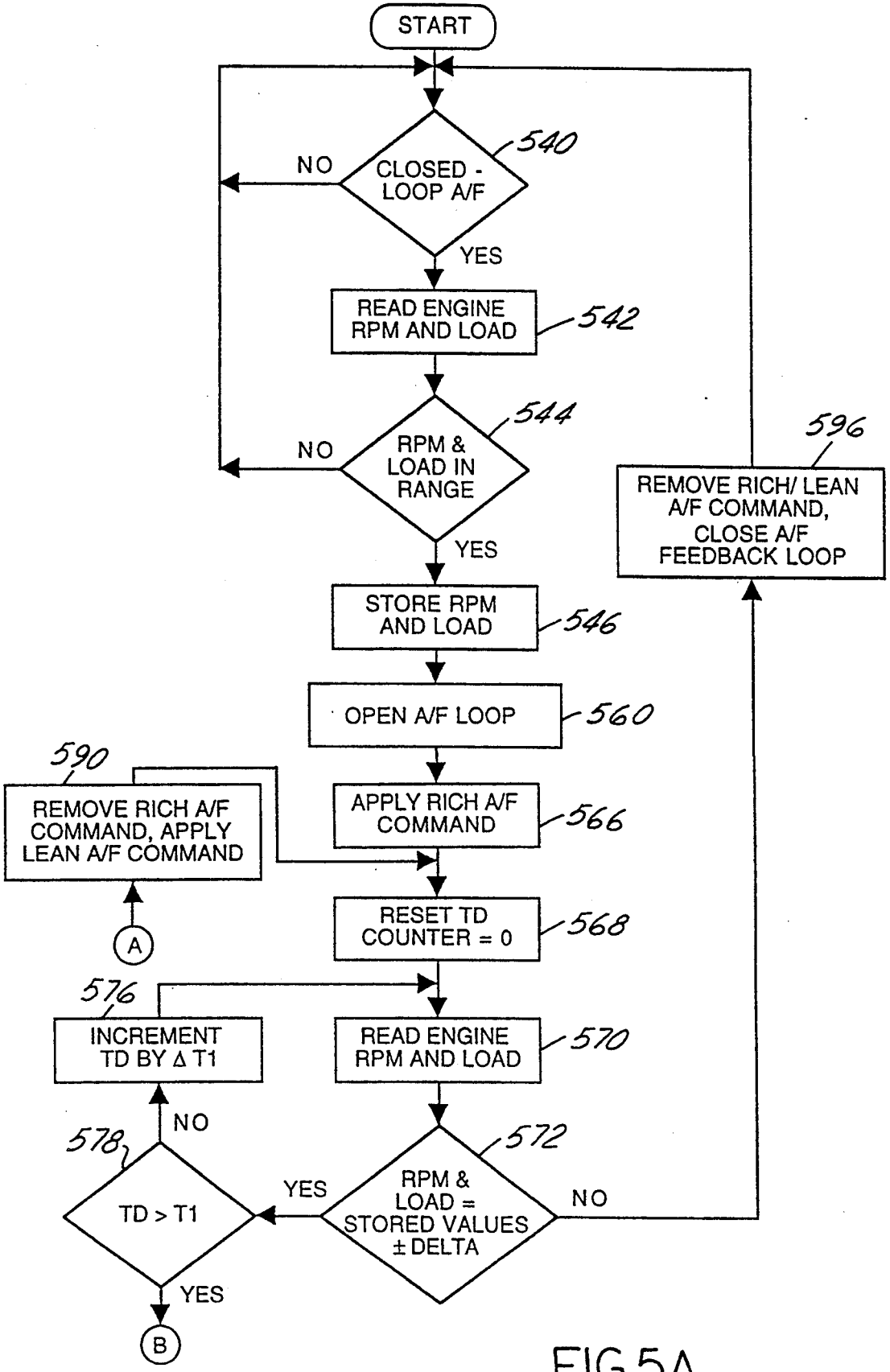
Figure 5B:
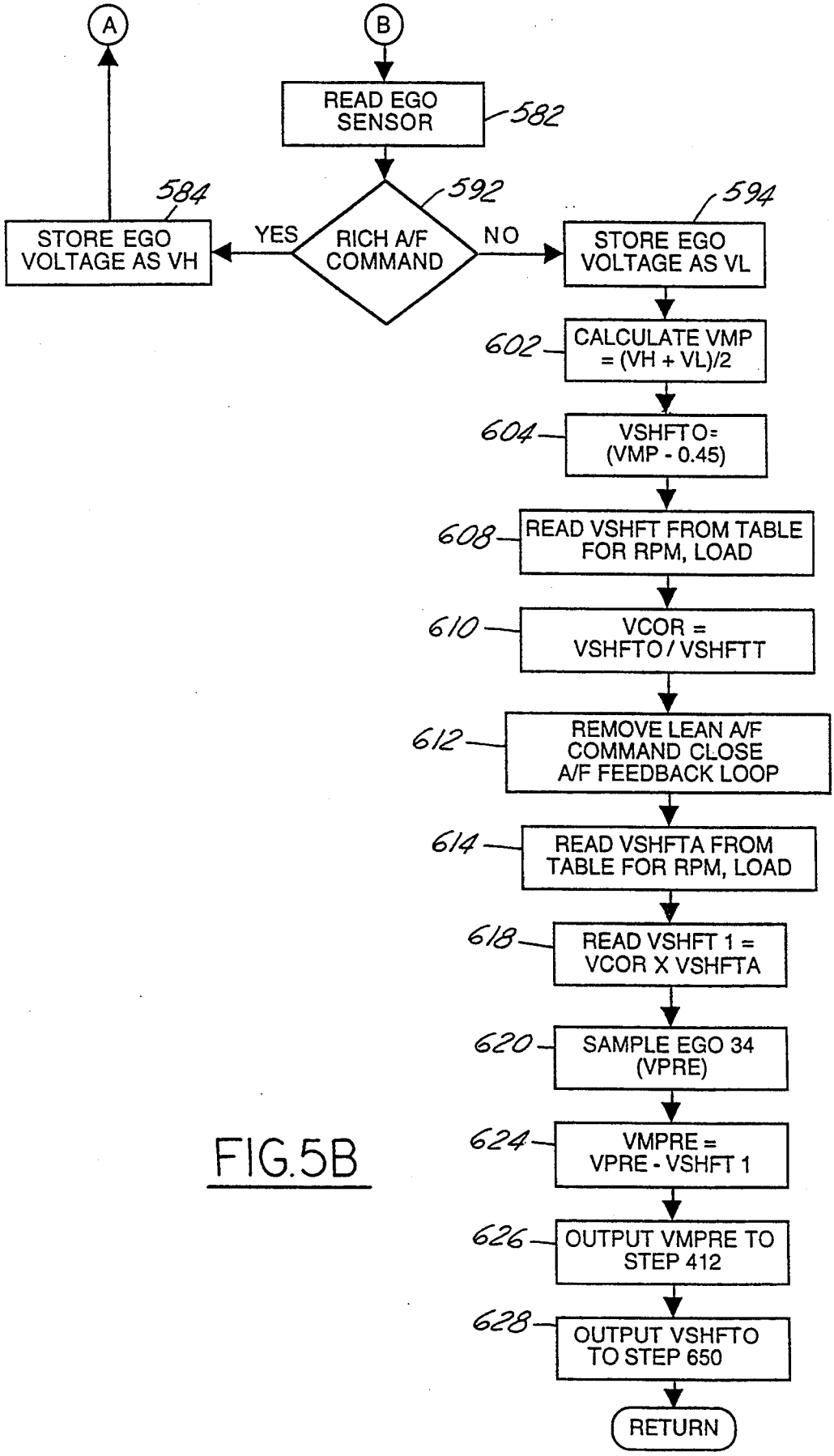

The adaptive correction for shifts in the amplitude output of EGO sensor 34 is now described with reference to FIGS. 5A–5B. After closed loop or feedback air/fuel control is enabled (step 540), engine speed and load are read (step 542) and stored (step 546) if they are within a preselected range (step 544). Closed loop feedback control is then disabled (step 560).

While feedback air/fuel control is disabled, a rich open loop offset is applied to the engine air/fuel ratio during step 566. This rich offset is sufficiently large to force EGO sensor 34 into the saturated rich indicating state. Concurrently, counter TD is reset to zero in step 568. While engine speed and load are within predetermined range DELTA of the previously stored rpm and load values (steps 570 and 572), counter TD is incremented by amount AT1 (step 576). When counter TD reaches maximum count T1 (step 578) which provides sufficient time for the rich offset to reach EGO sensor 34, the output voltage of EGO sensor 34 is read (step 582) and stored as value VH (step 584).

Subsequently, the rich open loop air/fuel command is disabled and a lean open loop air/fuel command is enabled during step 590. The lean offset is sufficiently large to force EGO sensor 34 into the lean saturated indicating state. The operation described above with respect to the rich air/fuel offset is then repeated for lean operation until counter TD reaches maximum value T1 (steps 568–578). EGO sensor 34 is then read (step 582) and its output voltage stored as voltage VL (steps 592–594).

If at anytime during the above described operation, engine speed and load exceed the previously stored values (step 546) by amount DELTA (step 572), feedback air/fuel control is resumed and the rich and lean air/fuel commands removed (step 596).

After high and low voltages VH and VL are stored, the average thereof is determined in step 602. Stated another way, the mean value of peak-to-peak excursions in the saturated output of EGO sensor 34 is calculated during a test period in which engine 24 is forced to operate rich and subsequently lean for predetermined times. The shift in this average value from the initial midpoint reference (see line 32 in FIG. 2A) is then determined during step 604 and its output signal designated as VSHFT0. Estimated voltage shift VSHFTT is then read from a look up table having engine rpm and load as its inputs during step 608. Correction ratio VCOR is determined by dividing voltage shift VSHFTT from the look up table into voltage shift VSHFT0 which was observed or calculated during the above described test (step 610). The lean air/fuel command is then removed and feedback air/fuel closed loop control resumed during step 612, thereby concluding an adaptive learning process.

Having adaptively learned correction ratio VCOR, it is applied during feedback air/fuel control as follows: Actual voltage shift VSHFTA is read from a look up table having engine rpm and load as inputs (step 614). Voltage shift VSHFT1 is then determined by multiplying correction ratio VCOR times voltage shift VSHTA (step 618). Accordingly, an adaptively learned correction ratio is multiplied times the looked up value to correct for variations in EGO sensor 34 output caused by factors such as aging and temperature variations.

The actual value of EGO sensor 34 output is subsequently sampled as signal VPRE in step 620. During step 624, sampled EGO sensor output VPRE is modified or corrected by subtracting previously determined voltage VSHFT1. During step 626, the resulting modified voltage (VMPRE) is transferred to step 412 (see FIG. 4) and closed loop feedback air/fuel control performed as previously described herein. In step 628, observed voltage shift VSHFTO is transferred to step 650 of the EGO sensor indicating routine described below with reference to FIG. 6.

Figure 6:
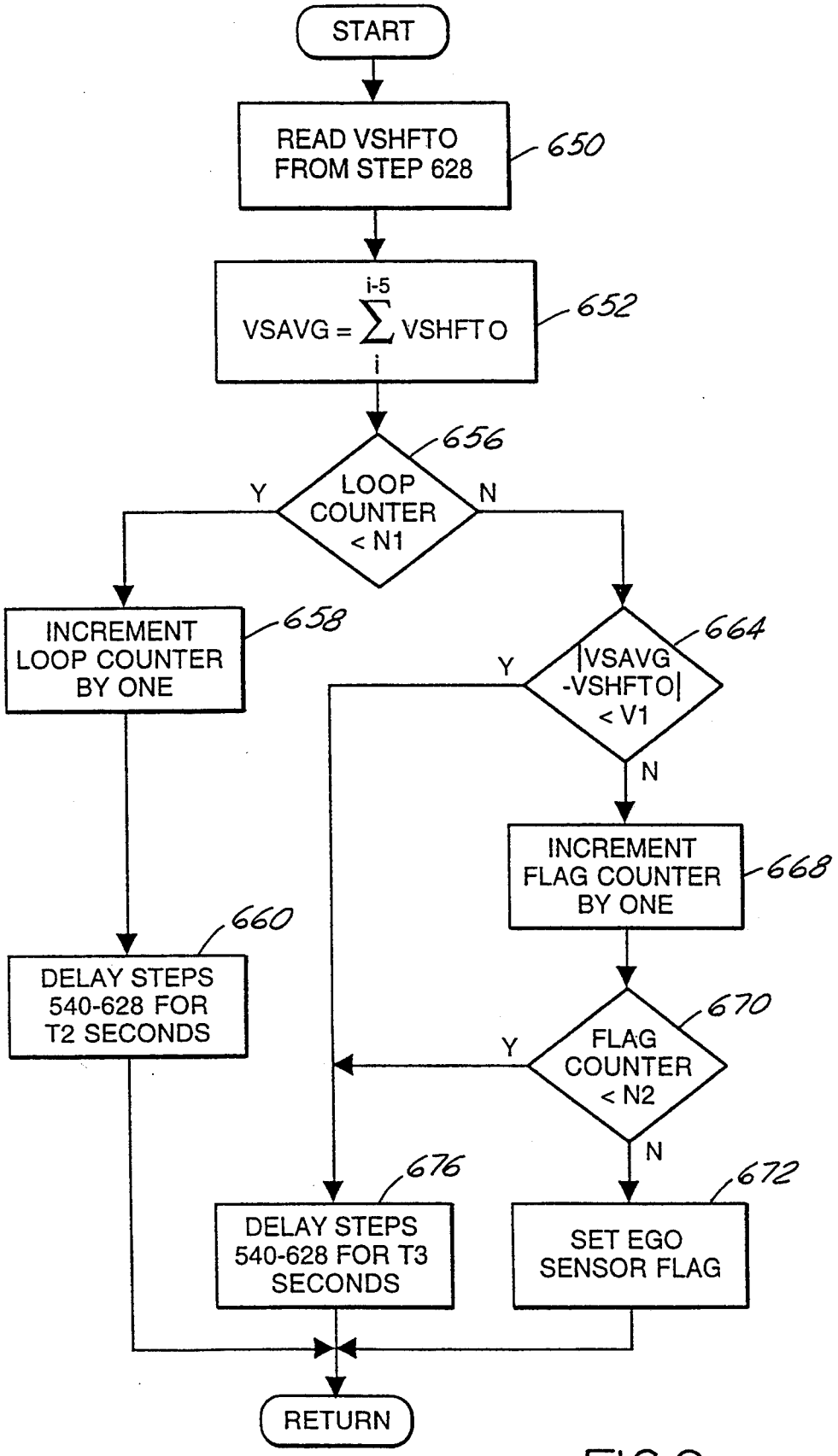

Referring now to FIG. 6, observed voltage shift VSHFTO is read from step 628 of the adaptive learning routine previously described with reference to FIGS. 5A–5B (see step 650). A rolling average of the last five observed voltage shifts (VSHFTO) is then calculated in step 652 to generate average voltage VSAVG. A count of background loop counter is compared to preselected number of background loops N1 in step 656. When less than N1 background loops have been executed, the loop counter is incremented by one (step 658) and the adaptive learning routine described with reference to steps 540–628 in FIGS. 5A–5B is disabled for predetermined time T2 (step 660). The effect of step 656–660 is to delay adaptive learning of voltage shift VSHFTO until a matured rolling average value VSAVG has been established after initiation of engine operation.

When the number of background loops executed exceeds N1 (step 656), the absolute difference between average voltage shift VSAVG and observed voltage shift VSHFTO for this particular background loop is compared to predetermined value V1. When this absolute difference exceeds value V1, indicating that EGO sensor output is less stable than desired, the flag counter is incremented by one (step 668). When the flag counter exceeds preselected value N2 (step 670), the EGO sensor flag is set in step 672. When the absolute difference between average voltage shift VSAVG and observed voltage shift VSHFTO for this particular background loop is less than preselected value V1, adaptive learning steps 540–628 previously described herein with reference to FIGS. 5A–5B are delayed for predetermined time T3. In this manner, open loop interruptions of feedback air/fuel control are minimized by the adaptive learning routine when indications are provided that EGO sensor 34 is operating as desired.

Although one example of an embodiment which practices the invention has been described herein, there are numerous other examples which could also be described. For example, other combinations of analog devices and discrete ICs may be used to advantage to generate the current flow in the sensor electrode. The invention is therefore to be defined only in accordance with the following claims.

What is claimed is:

1. An engine air/fuel control method for correcting an output of an exhaust gas oxygen sensor positioned in the engine exhaust in series with a catalytic converter, comprising the steps of:

controlling the engine air/fuel ratio in response to a comparison of the sensor output with a reference value;

forcing engine air/fuel operation sufficiently rich and then sufficiently lean of a preselected air/fuel ratio during a test period to force the sensor output into its respective saturated rich indicating state and saturated lean indicating state; and shifting the sensor output to align a midpoint between output amplitude at said saturated rich indicating state and output amplitude at said saturated lean indicating state with said reference value.

2. The method recited in claim 1 further comprising the steps of generating a feedback control signal by integrating said comparison of said reference value to the sensor output and adjusting fuel delivered to the engine in response to said feedback control signal.

3. The method recited in claim 2 wherein said step of adjusting fuel in response to said feedback control signal is disabled during said test period.

4. The method recited in claim 1 wherein said sensor output is shifted by a voltage shift generated by subtracting said reference value from said midpoint.

5. The method recited in claim 4 further comprising the step of averaging said voltage shifts to provide an indication of sensor stability.

6. The method recited in claim 5 wherein said step of indicating sensor stability includes a step of comparing an absolute difference between said voltage shift and said average voltage shift to a preselected value.

7. The method recited in claim 6 further comprising the step of delaying said test for a preselected time after said comparison test indicates acceptable sensor stability.

8. The method recited in claim 1 further comprising the step of disabling said test for a predetermined time after engine start up.

9. The method recited in claim 2 further comprising the step of trimming said feedback control signal in response to an error signal derived from an exhaust gas oxygen sensor positioned downstream of the converter and wherein said step of adjusting fuel delivered to the engine is responsive to said trimmed feedback variable.

10. The method recited in claim 9 wherein said error signal is generated by integrating a difference between an output of said downstream sensor and a predetermined reference.

11. An engine air/fuel control method for correcting an output of an exhaust gas oxygen sensor positioned in the engine exhaust in series with a catalytic converter, comprising the steps of:

controlling the engine air/fuel ratio in response to a comparison of the sensor output with a reference value;

generating a correction voltage during a test period in which engine air/fuel operation is first forced sufficiently rich and then forced sufficiently lean of stoichiometry for preselected time periods to force the sensor output into its respective saturated rich indicating state and saturated lean indicating state, said correction voltage being generated by subtracting said reference from a value related to both amplitude in the sensor output at said saturated rich indicating state and the sensor output amplitude at said saturated lean indicating state;

correcting said sensor output with said correction voltage; and indicating sensor stability in response to an average of said correction voltages over a preselected number of test periods.

12. The method recited in claim 11 wherein said value related to the sensor output amplitude at said saturated rich indicating state and the sensor output amplitude at said saturated lean indicating state is selected at a midpoint in the sensor output amplitude at said saturated indicating states.

13. The method recited in claim 11 wherein said engine air/fuel ratio controlling step is also responsive to an error signal derived by integrating a difference between an output of an exhaust gas oxygen sensor positioned downstream of the converter and a predetermined value.

14. The method recited in claim 11 wherein said step of controlling the engine air/fuel ratio is forced to be independent of the sensor output during said test period.

15. An engine air/fuel control method for correcting an output of an exhaust gas oxygen sensor positioned in an engine exhaust upstream of a catalytic converter, comprising the steps of:

generating an error signal related to a difference between a signal derived from an exhaust gas oxygen sensor positioned downstream of the converter and a predetermined value;

feedback control of the engine air/fuel ratio in response to a feedback variable derived by integrating a difference between the upstream sensor output and a reference value, said feedback control also being responsive to said error signal;

disabling said feedback control during a test period;

forcing engine air/fuel operation sufficiently rich and then sufficiently lean of a preselected air/fuel ratio during a test period to force the sensor output into its respective saturated rich indicating state and saturated lean indicating state;

determining a voltage shift related to a difference between said reference and a midpoint between the sensor output amplitude at said saturated rich indicating state and said saturated lean indicating state;

generating a correction ratio of said voltage shift to a stored value related to engine operating conditions during said test period;

correcting said upstream sensor output with a correction voltage derived by multiplying said correction ratio times an estimated correction derived from engine operating conditions; and indicating sensor stability by averaging said correction voltages over a preselected number of test periods and comparing an absolute difference between said correction voltage and said average correction voltage to a preselected reference during said test period.

16. The method recited in claim 15 wherein said test period predetermined time and preselected time are substantially equivalent.

* * * * *